United States Patent [19]

Maxwell, Jr.

[11] 4,385,834

[45] May 31, 1983

[54] LASER BEAM BORESIGHT SYSTEM

[75] Inventor: Richard F. Maxwell, Jr., Catonsville, Md.

[73] Assignee: Westinghouse Electric Corp., Pittsburgh, Pa.

[21] Appl. No.: 172,785

[22] Filed: Jul. 28, 1980

[51] Int. Cl.[3] ..... G01B 11/27

[52] U.S. Cl. ..... 356/153; 356/138

[58] Field of Search ..... 356/138, 141, 152–153; 358/125–126; 219/121 LU, 121 LV, 121 LW, 121 LX

[56] References Cited

U.S. PATENT DOCUMENTS

| | | | |
|---|---|---|---|
| 3,432,240 | 3/1969 | Jackson | 356/152 |
| 3,752,587 | 8/1973 | Myers et al. | 356/153 |
| 3,902,036 | 8/1975 | Zaleckas | 219/121 LX |
| 3,942,894 | 3/1976 | Maier | 356/138 |
| 4,015,906 | 4/1977 | Sharon | 356/138 |
| 4,155,096 | 5/1979 | Thomas et al. | 358/125 |
| 4,314,276 | 2/1982 | Woolfson | 356/153 |

*Primary Examiner*—William H. Punter

*Attorney, Agent, or Firm*—R. M. Trepp

[57] ABSTRACT

Boresighting of an outgoing first laser beam axis to an imaging sensor reference axis is described by aligning a second laser beam axis, which is in fixed relation to the first laser beam axis, to an electromagnetic source reference beam axis and detecting the angular displacement between the second laser beam and the reference beam axes. The sensor reference axis is in fixed relationship to the reference beam axis. Error signals are generated by the detector which are proportional to the angular displacement and are utilized to correct the angular displacement to align the second laser beam and the reference beam axes. When the first laser beam is boresighted to the sensor reference axis, the image of the reference beam source in the sensor display will represent the target object to which the outgoing first laser beam is directed.

15 Claims, 10 Drawing Figures

LASER BEAM BORESIGHT SYSTEM

BACKGROUND OF THE INVENTION

1. Field of the Invention

This invention relates to laser beam boresight systems and particularly to the angular displacement of the laser beam from a reference axis.

2. Description of the Prior Art

Electro-optical laser designators are used in laser guided weapons delivery systems to illuminate a selected target in a target scene with a beam of energy from a laser. The reflection of this illumination is used by the weapon system to guide a weapon to the selected target. Electro-optical laser designators may employ an image sensor to view and track a desired target in the field of view. A target may be selected by an operator or by a screening circuit. The target position in the scene or field of view is centered or referenced to the boresight axis of the image sensor. As is well known, precise alignment of the laser beam axis with the boresight axis of the image sensor requires aligning the laser beam axis to within tenths of a milliradian, otherwise errors in the desired and actual target designation will occur causing error in weapons delivery accuracy.

The laser beam may be invisible to both the operator and the image sensor preventing direct monitoring of the alignment of the laser beam axis.

Even in systems with precise alignment initially, errors in alignment of the beam of energy repetitively emitted by the laser are likely to occur because of unintended angular displacements of the successive laser beam caused by stresses in the laser and its supporting structure arising from mechanical and thermal effects. One approach employed to maintain precise alignment and to reduce alignment errors is to construct the structure rigid enough so that deflections under severe dynamic loads would be greatly limited. The weight of the structure needed to provide the required rigidity is significant. For some applications such as in man-portable and in small remotely piloted vehicle (RPV) systems, the weight of the system is a critical parameter.

One approach to the alignment of a laser beam is the technique disclosed in U.S. Pat. No. 4,155,096 issued May 1979 to Thomas, et al. Thomas describes a system wherein the laser beam itself provides the boresight reference axis. When the boresighting procedure is to be employed, the laser beam is temporarily shifted from the output port and target scene to a different direction and a small portion of the beam is permitted to be transmitted through an optical system and focused as a spot image on the faceplate of an imaging sensor. A target tracker is then locked-on to the laser spot and, when the system has stored the position information regarding the image, the laser beam is redirected to the output port. While the laser beam is directed to the output port, no portion of the beam is transmitted to the sensor. The tracker will utilize that laser image as the boresight position of the laser beam on the presumption that no changes will occur to the beam's alignment during the period of time the laser is directed away from the sensor. However, mechanical and thermal stresses will ordinarily continually occur to the laser and its supporting structure which could affect the alignment of the laser beam. The inability to continually monitor and update the alignment of the laser beam during the tracking mode appears to be a limitation of that system. An additional limitation is that other operating modes must be inhibited until such a time as the boresighting mode has been completed; also the frequency of the laser beam must be within the frequency response spectrum of the imaging sensor.

Another approach to the alignment of a laser beam with respect to a target is described in U.S. Pat. No. 4,015,906 issued on Apr. 5, 1977 to Uzi Sharon. In U.S. Pat. No. 4,015,906, a portion of the laser beam is reflected and focused onto a surface of a plate which glows when impinged by a laser beam. A microscope which is aligned on an axis parallel to but spaced laterally from an axis of the laser beam receives by means of a beam splitter radiant energy from the glowing spot on the plate indicative of the position of the laser beam in the field of view of the microscope. The system enables laser boresighting on a target in a scene or field of view prior to exposing the target to the laser beam by opening a shutter.

With regard to measuring alignment, a beam alignment sensor for measuring the angular alignment and linear displacement of a collimated beam of light relative to a fixed reference surface is described in U.S. Pat. No. 3,942,894, issued on Mar. 9, 1976 to Dennis A. Maier. In U.S. Pat. No. 3,942,894, an annular mirror provides a fixed reference member with which the main beam is aligned utilizing light reflected from the beam which is focused on a mirrored prism to determine angular misalignment. Another sensor determines the lateral displacement of the beam portion directed to the mirrored prism.

It is therefore desirable to provide a system for automatic and continuous updating of the alignment of the laser beam axis each time the laser emits a beam of energy.

It is further desirable to provide a system in which the frequency response range of the imaging sensor may be independent of the laser frequency so that the same laser frequency can be employed whether, for example, a TV sensor is to be utilized for daylight operation or a Thermal Imaging sensor is to be utilized for operation under low light level conditions.

It is further desirable to provide a system wherein the rigid supporting structure formerly required to overcome deformation effects on the alignment position of the laser beam is not required.

SUMMARY OF THE INVENTION

In accordance with the present invention, apparatus for directing a laser beam to an object in a field of view, for maintaining alignment of the laser beam and for indicating the position of the laser beam in the field of view on an image-detector is provided comprising a laser beam directed through a movable lens into a first beam splitter where most of the incident beam energy is reflected from the first beam splitter toward an object in the field of view, a portion of the laser beam passes through the first beam splitter into a second beam splitter where most of the incident beam energy is reflected from the second beam splitter onto the surface of a quadrant detector, the quadrant detector generates an error signal as a function of position which is coupled to servo motors, for example, for positioning the movable lens to maintain the alignment of the laser beam by positioning the laser beam at a predetermined position on the quadrant detector. Radiant energy from the scene in the field of view passes through the first beam splitter which is transmissive to the radiant energy from the field of view and through a focussing means for focussing an image of the field of view onto the image detector. The image detector also receives an independent source of radiant energy which is focussed into a spot and represents the position of impingement of the laser beam in the field of view. The independent source of radiant energy has a focal point beyond the second beam splitter at the same distance from the point of beam splitting as the quadrant detector and passes through the second beam splitter which is transmissive to the independent source of radiant energy and along the same path of the laser beam from the second to the first beam splitter and is reflected by the first beam splitter through a focussing means onto the image detector as a spot indicative of the position of the laser beam in the field of view on the image detector.

DESCRIPTION OF THE PREFERRED EMBODIMENT

Figure 1:
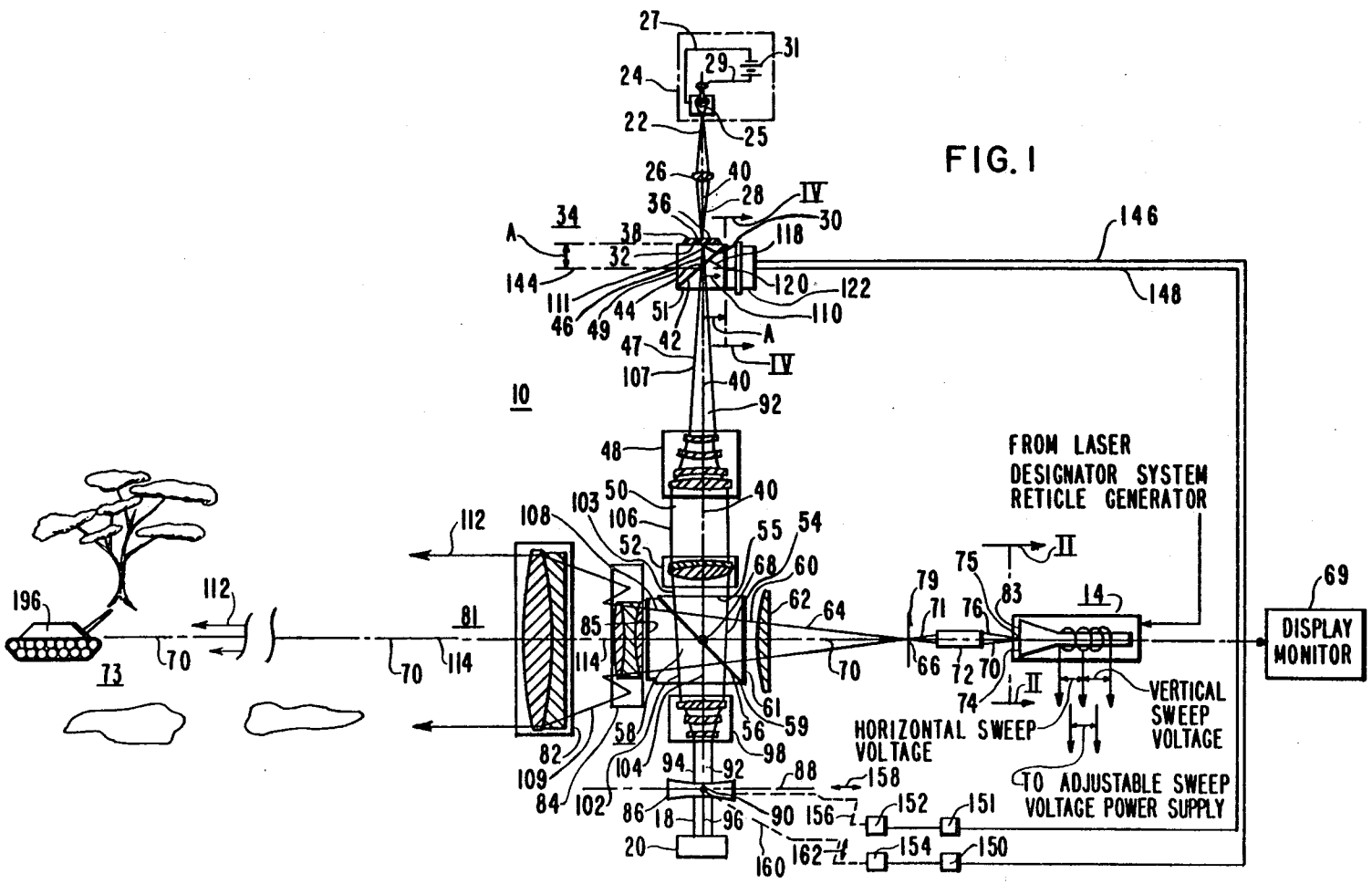
FIG. 1 is a schematic diagram of one embodiment of the invention.

Referring to FIG. 1, a radiation beam 22, emitted by a conventional electromagnetic radiation source 24, is converged by condensing lens 26. The converged beam 28 is forcused at focal point 30 located at surface 32 of a beamsplitter 34. Beam 28 is transmitted through aperture 36 which is surrounded by light absorbing material 38 to absorb extraneous radiation and to prevent secondary reflections. The centroid or, as commonly referred to, the optical axis 40 of beams 22 and 28 passes through focal point 30 and intersects dichroic mirror 42 of beamsplitter 34 at point 44.

Figure 5:
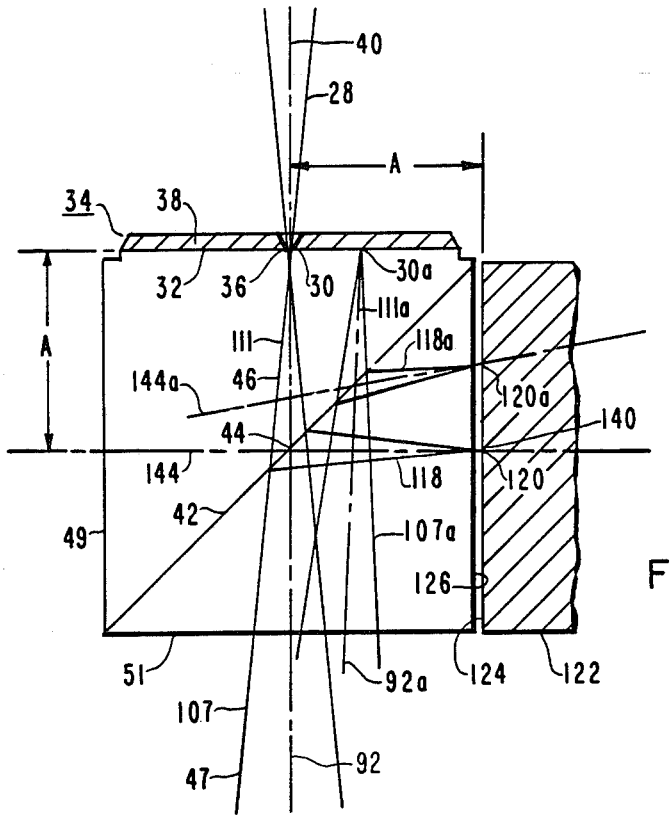
FIG. 5 is an enlarged view of a portion of FIG. 1 showing the optical paths of a laser beam through a beam splitter when its axis is aligned and when it is not aligned with the reference axis of the radiation source beam.

Referring to FIGS. 1 and 5, dichroic mirror 42 has a reflectance on the order of 0.0001 at the wavelength of the conventional radiation source 24 which may originate from a light emitting diode 25, consequently 99.99% of the energy in beam 46 diverging from focal point 30 is transmitted through mirror 42 as beam 47 and only 0.01% is reflected by mirror 42 through face 49 of beamsplitter 34 as a negligible loss. Focal point 30 and mirror point 44 are separated by a space interval or predetermined distance A. Diverging beam 47 passes through face 51 of the beamsplitter 34 and passes through collimating lens 48. The collimated beam 50 passes through objective lens 52 and the converged beam 54 passes through face 55 of a beamsplitter 58.

Beam 54 is reflected by dichroic mirror 56 of beamsplitter 58. Dichroic mirror 56 has a reflectance on the order of 0.9999 at the wavelength of the radiation source 24. Consequently, 99.99% of the energy in beam 54 is reflected through face 61 of beamsplitter 58 as beam 60 and only 0.01% is transmitted through mirror 56 and face 59 as a negligible loss. Beam 60 is converged by objective lens 62 as beam 64. Beam 64 is focused at the image focal point 66, diverges as beam 71 to field of view change lens 72, and focuses as beam 76 to an image of radiation source 24 at focal point 75 on the photosensitive faceplate 74 of sensor 14 shown in FIG. 2.

An optical beam axis 40 intersects sequentially the radiation source focal point 30 and mirror point 44, passes through the centroids of beams 47, 50 and 54, and intersects dichroic mirror 56 at point 68. Axis 40 is the system reference axis to which laser beam axis 92 is aligned.

An optical beam axis 70 intersects mirror point 68 and image focal point 75 and is the imaging sensor boresight reference axis; it has a fixed relationship with respect to axis 40.

Figure 2:
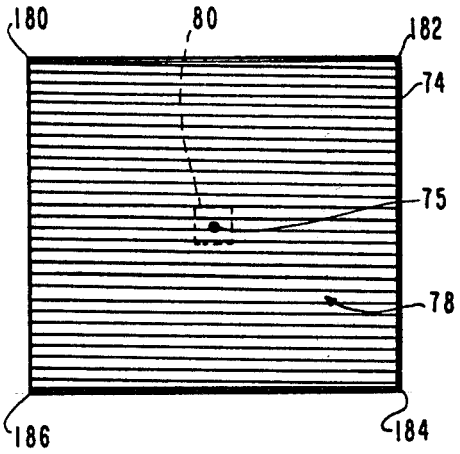
FIG. 2 is a cross section view along the lines II—II of FIG. 1.

The image of radiation source 24 at focal point 75 will be focused on faceplate 74 as shown in FIG. 2. In a typical laser designator system, a raster 78 may be added to display images on the photosensitive faceplate 74 of sensor 14 and a reticle arrangement may be added to the sensor display such as, for example, a "broken-box" window 80. If image focal point 75 should be off-center with respect to reticle 80, such as may possibly occur at initial start-up, the raster horizontal and vertical sweep circuit voltages respectively may be manually adjusted in a conventional manner or automatically by the associated laser designation system in order to adjust the raster 78 until the image of radiation source 24 at focal point 75 is centered within the reticle 80.

Figure 3:
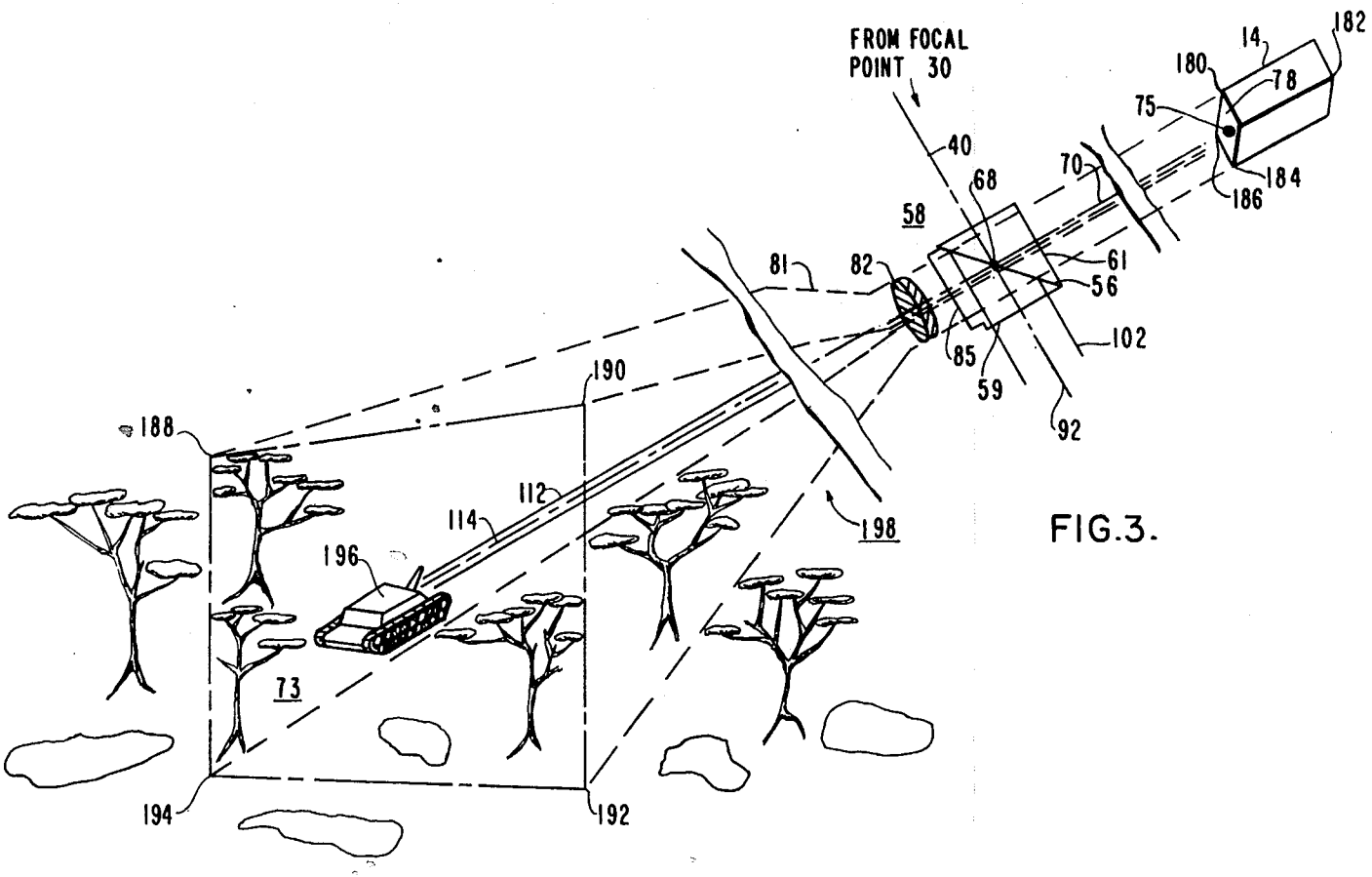
FIG. 3 is a fragmentary illustration of the relationship of the boresighted laser beam with the target scene and sensor of FIG. 1.

Referring to FIGS. 1, 2 and 3 beam axis 70 intersects image focal point 75 and extends linearly through mirror point 68 to the target scene 73 as viewed by sensor 14. Sensor 14 will display both the target scene 73 and image focal point 75 on display monitor 69 wherein each is intersected by axis 70. The target scene 73 entering laser beam boresight system 10 at port 81 will pass through converging lenses 82, 84, and 62 and is focused at image focal point 66 as image 79 and focused at faceplate 74 of sensor 14.

Referring to FIG. 1, a laser beam 18 having an optical axis 96 is emitted from laser 20 and passes through a beam steering lens 86 which is movable along mutually orthogonal axes 88 and 90, at a maximum displacement on the order of 10 millimeters. A lateral displacement of lens 86 along these axes will change the direction of laser beam 18 passing through lens 86 to change the geometric alignment of optical axis 92 of laser beam 94 with respect to optical axis 96 of laser beam 18. Laser beam 94 is expanded by lens 98 to reduce the energy density of laser beam 94 passing into beamsplitter 58 at face 59 as laser beam 102. The centroid or optical axis 104 of laser beam 102 may be a linear extension of optical axis 92.

Dichroic mirror 56 of beamsplitter 58 has a reflectance on the order of 0.997 at the wavelength of a conventional laser having a wavelength of, for example, 1.064 micrometers. Consequently, 99.7% of the energy in laser beam 102 is reflectd by dichroic mirror 56 as laser beam 108 which exits through collimating lens 84 and objective lens 82 respectively to the outlet port 81 of laser beam boresight system 10 as a collimated laser beam 112 having an optical axis 114.

Lenses 84 and 82 decrease the divergence of laser beam 108 without reducing the energy density of the laser beam 18. For example, beam 18 may be a 0.635 centimeter diameter beam with a 2 milliradian divergence at lens 86 and exit as laser beam 112 from the objective lens 82 with a 5.08 centimeter diameter beam and a beam divergence of $\frac{1}{4}$ milliradian. Since the product of the beam diameter and divergence is constant, the brightness of laser beam 18 is preserved in laser beam 112 while the energy density of laser beam 102 at beamsplitter 58 is reduced.

FIG. 3 illustrates the relationship between raster 78, the radiant energy 198 from the target scene 73 as viewed through outlet port 81 from sensor 14, and laser beam 112 when axis 114 of laser beam 112 is collinear with or, as usually expressed, boresighted to the sensor boresight reference axis 70 extended and when laser axis 92 is responsively aligned with source reference axis 40 extended. When axis 114 is boresighted to axis 70 extended, axes 92 and 114 will intersect dichroic mirror 56 at point 68 and source image point 75 and target object 196 will be intersected by axis 114 extended. Summarizing, source image 75 will correspond to the target object 196 within the target scene 73 displayed on imaging sensor 14 only when laser axis 114 is boresighted to sensor boresight reference axis 70 extended. Target scene 73 displayed on sensor 14 is established by the dimensions of raster 78 where raster points 180, 182, 184, and 186 correspond to target scene 73 points 188, 190, 192, and 194 respectively. Laser beam 112 has a long focal length when it exits outlet port 81 wherein its beam divergence is on the order of 0.25 milliradian. The target scene 73 has angular dimensions on the order of $3° \times 4°$; its actual configuration varies and is dependent on the topology of the ground and objects thereon and will appear in the raster 78 as image 83. Dichroic mirror 56 has a transmissivity on the order of 99.99% to the desired wavelengths of radiant energy 198 from target scene 73 other than that of the laser and reference source wavelengths. Consequently, 99.99% of the radiant energy 198 from the target scene 73 at face 85 of beamsplitter 58 is transmitted by mirror 56 through face 61 to sensor 14 and 0.01% is reflected through face 59 as a negligible loss of radiant energy 198 from the target scene 73.

Referring to FIG. 1, dichroic mirror 56 of beamsplitter 58 has a relatively small optical leakage transmissivity, on the order of 0.003, at the wavelength of laser beam 102. Laser leakage beam 103 passes through mirror 56 of beamsplitter 58 and through face 55. Typically, 0.3% of the energy of laser beam 102 is in beam 103. Laser beam 103 is converged by lens 52 and the converged laser beam 106 is further converged by lens 48 as laser beam 107 to pass into beamsplitter 34 through face 51 and reflected by dichroic mirror 42.

Referring to FIGS. 1 and 5, dichroic mirror 42 has a reflectance on the order of 0.997 at the wavelength of the laser leakage beam 107. Consequently, 99.7% of the energy in laser beam 107 propagates through face 126 of beamsplitter 34 as shown by arrow 110. The other 0.3% of the energy of laser beam 107 is leaked through dichroic mirror 42 as laser beam 111. Each of the laser beams 94 and 102 and laser leakage beams 103, 106, 107 and 111 after propagating through lens 86 include the entire solid angle of laser beam 18 so that a common centroid or optical axis 92 is employed for deflected beams 94 and 102 and for leakage beams 103, 106, 107 and 111. When the laser beam optical axis 92 intersects dichroic mirror 56 at point 68, it will be aligned with radiation source optical axis 40 and will intersect mirror 42 at point 44. The focal point of laser leakage beam 111 will be at point 30 coincident with the focal point of source beam 28 as established by the relative position of beam steering lens 86 with respect to aperture 36 and the optical arrangement between lens 86 and aperture 36.

Optical axis 114 is common to and passes through laser beam 108, 109, and 112. When laser beam 102 has its optical axis 92 intersect point 68, the laser beam reflected by mirror 56 has laser beam axis 114 intersecting mirror point 68, laser beam axis 114 is then a linear extension of the sensor boresight reference axis 70 and is collinear with axis 70 extended.

Referring to FIGS. 1 and 5, when beam axis 92 intersects dichroic mirror 42 of beamsplitter 34 at point 44, laser beam 107 will be substantially reflected by mirror 42 as beam 118 and will be focused at point 120 located a distance A from point 44 of the dichroic mirror 42. A conventional laser quadrant detector 122, such as type SGD-444-4 of E. G. and G., Inc., Boston, Mass., is positioned so that its energy-sensitive faceplate 124 is adjacent to face 126 of beam-splitter 34 and the focal point 120 of the reflected laser beam 118 is at detector face 124. Focal point 120 is typically a small filled-in circular area having a diameter on the order of 0.01 cm.

Figure 4:
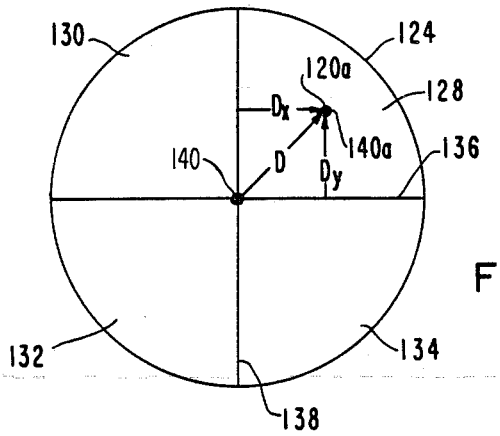
FIG. 4 is a cross-section view along the lines IV—IV of FIG. 1 showing a typical quadrant detector with the point image of the laser leakage beam displaced from the detector null point.

Referring to FIG. 4, detector faceplate 124 is typically divided into four equal sectors or quadrants 128, 130, 132, and 134 which are separated by mutually perpendicular lines 136 and 138 and a null point 140 at the intersection of said lines. As is well known by those skilled in the art, and as described in the technical literature such as, for example, "The Infrared Handbook" prepared by the Environmental Research Institute of Michigan, 1978, Library of Congress Catalog Card No. 77-90786, Chapter 22, the respective quadrants of detector 122 will generate electrical error signals when the laser focal point 120 is in contact with one or more of the quadrants rather than at null point 140. The amplitude of an error signal will be proportional to the displacement of laser focal point image 120 from the common or null point 140. A first electrical error signal, $E_x$, will be generated whose amplitude is proportional to the displacement of laser focal point image **120*a* along line 136 from null point 140 and a second electrical error signal, $E_y$, will be generated whose amplitude is proportional to the displacement of laser focal point image 120*a* along line 138 from null point 140. When laser focal point image 120 is at null point 140, there will be no electrical output from detector 122 since, as is well known, the sum of the signals from the four quadrants will cancel, and, referring to FIGS. 4 and 5, optical axis 144 of beam 118 will intersect null point 140 and mirror point 44. Reference axis 40** also intersects point 44. Axis 144 will be transverse to radiation source axis 40 such that after reflection of beam 118 from mirror 42, axis 92 will lie so that the aperture hole 36 and the null point of detector 122 appear at the same virtual location when viewed along axis 92 from point 68. Radiation source image focal point 30 and laser image focal point 120 will each be spaced from point 44 by the same length, A.

Referring to FIGS. 1, 4, and 5, when focal point 120 of beam 118 is not at null point 140 such as, for example, when focal point 120*a* of beam 118*a* is at detector point 140*a* displaced a distance D from null point 140, two displacement electrical error signals, $E_x$ and $E_y$, will be generated by detector 122 whose amplitudes will be respectively proportional to the displacement $D_x$ parallel to line 136 and displacement $D_y$ parallel to line 138. Error signals $E_x$, and $E_y$ will be conducted by lines 146 and 148 respectively, to controls 150 and 151 respectively in order to activate mechanical servo drives 152 and 154 respectively to displace lens 86 along transverse axes 88 and 90 respectively which may be orthogonal, for example. Mechanical coupling 156 is activated by servo drive 152 to move lens 86 parallel to axis 88 in the "x" direction as indicated by arrow 158 when control 151 is activated by $E_x$. Mechanical coupling 160 is activated by servo drive 154 to move lens 86 in a direction orthogonal to the "x" direction as indicated by arrow 162 which is parallel to axis 90, shown in FIG. 1, when control 150 is activated. The relationship and operation of servo drives 152 and 154 and controls 150 and 151 are well known to those skilled in the art. Lens 86 will be displaced in order that axis 92*a* shown in FIG. 5 will move toward axis 92 and axis 144*a* will move toward axis 144 until laser focal point 120*a* is at detector until point 140. When there is no displacement of the focal point 120*a* from null point 140, the error signals $E_x$ and $E_y$ will no longer activate servo drives 152 and 154 and the optical axis 92 of the laser beam 107 will be in alignment with the optical axis 40 of the radiation source beam 28. The angular displacement of the laser beam axis 92 from axis 40 is detected each time the laser 20 emits a beam of energy 18 and displacements of the beam steering lens 86 by the beam steering servos 152 and 154 are such that errors due to unintentional movements of laser beam 18 are typically automatically and continuously corrected within, for example, 0.1 second of time depending, of course, on the combined bandwidth of the error correction circuits including detector 122, controls 150 and 151, servo drives 152 and 154 and mechanical couplings 156 and 160.

For further clarification of the present invention, common optical elements conducting two beams in opposite direction in FIG. 1 comprise the optical path of the laser beam 108 from dichroic mirror 56 of beamsplitter 58 to the target scene 73 and the optical path of the target scene 73 to dichroic mirror 56 of beamsplitter 58. Common elements in FIG. 1 also comprise the optical path of the laser beam 103 from dichroic mirror 56 of beamsplitter 58 to the laser beam 118 focal point 30 at face 32 of beamsplitter 34 and the optical path of the radiation source beam 28 from its focal point 30 at face 32 of beamsplitter 34 to dichroic mirror 56 of beamsplitter 58.

Figure 6:
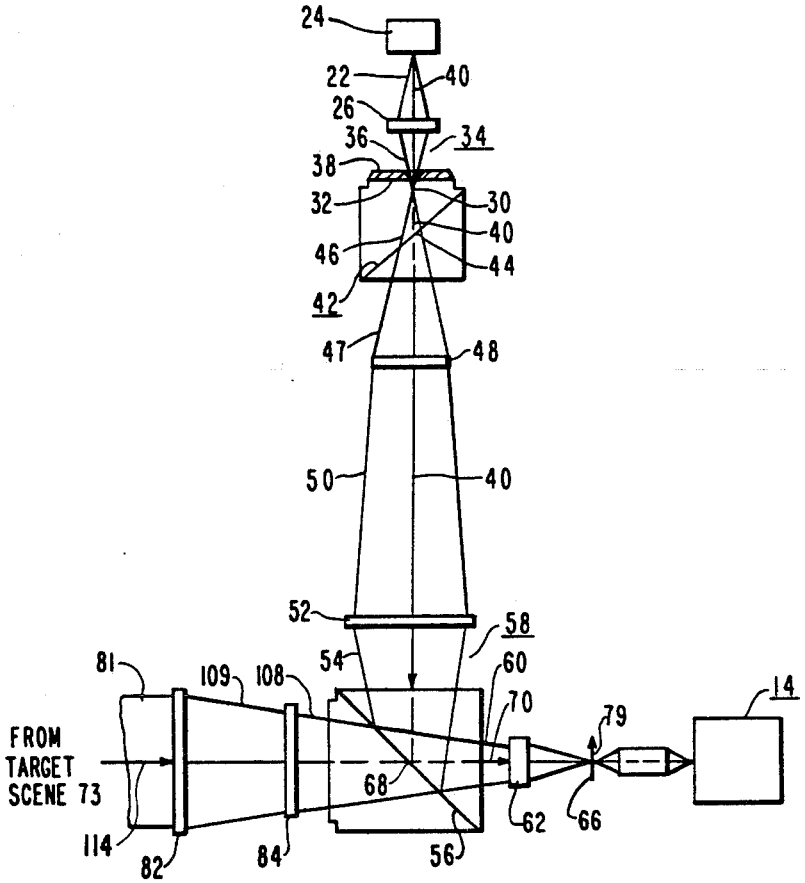
FIGS. 6 and 7 are a portion of the embodiment of FIG. 1 showing the common elements in the optical path of the laser beam from the beamsplitter to the output port and in the optical path of the target scene from the output port to the beamsplitter and the common elements in the optical path of the laser leakage beam from the beamsplitter to the radiation source aperture and in the optical path of the radiation source beam from the source aperture to the beamsplitter.

The optical paths of the boresight reference from source 24 to sensor 14 and of the target scene 73 to sensor 14 are illustrated in FIG. 6. Source reference axis 40 and boresight reference axis 70 are fixed in a predetermined relationship. Axis 114 of the beam of radiant energy 198 shown in FIG. 3 coming from target scene 73 is colinear with fixed axis 70 for the display of the target scene 73 on sensor 14.

Figure 7:
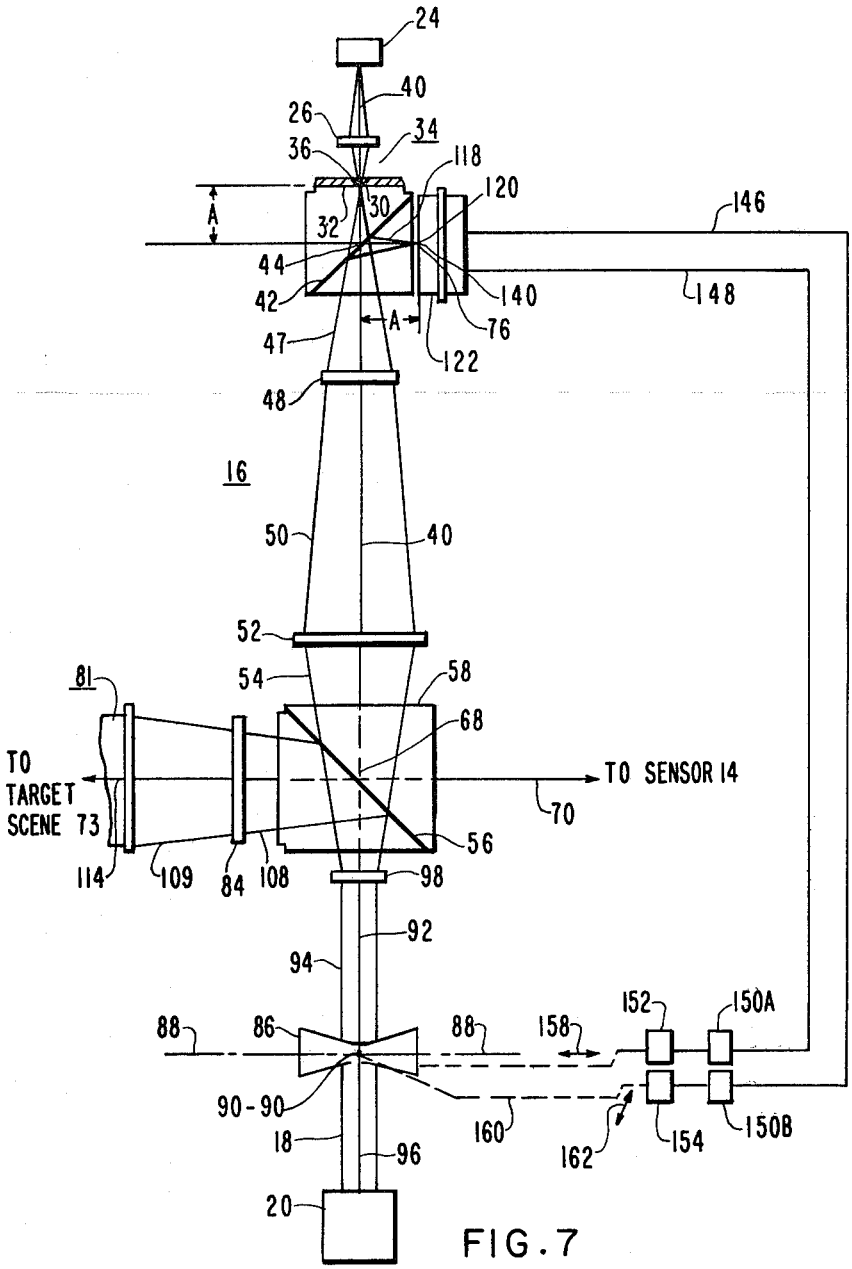

The optical paths of boresight reference axes 40 and 70, and of laser beam axes 96, 92, and 114 are shown in FIG. 7 when laser beam axis 92 is aligned with boresight reference axis 40 and when laser beam axis 114 is concomitantly boresighted to sensor boresight reference axis 70. In FIGS. 1, 5 and 7, the optical path is shown of the laser beam 118 as reflected by dichroic mirror 42 in a position when the laser image point 120 is at the null position 140 and axis 144 intersects mirror point 44 and point 120.

Figure 8:
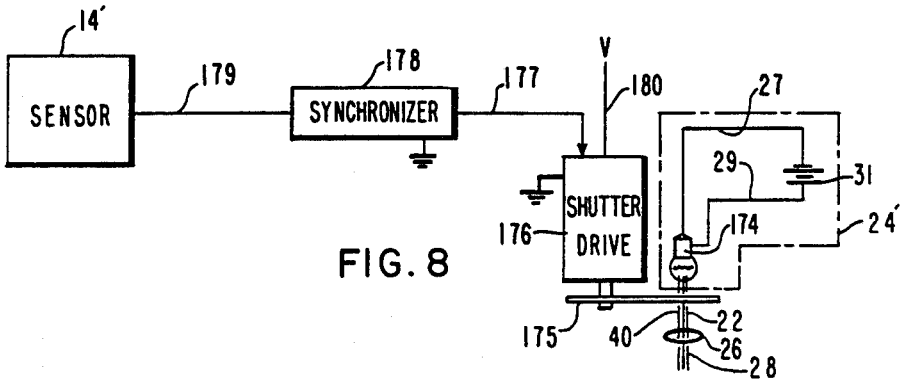
FIG. 8 is an illustration of a conventional infrared reference source.

Radiation source 24 has minimum restrictions as to its emission wavelength providing it is within the sensitivity range of imaging sensor 14 which may be, for example, a vidicon. For example, a conventional light emitting diode in the visible electromagnetic spectrum, emitting at a typical wavelength such as 6700 A is coupled over lines 27 and 29 across battery 31. An infared reference source 24′ using a controlled temperature filament 174, is illustrated in FIG. 8 and may be employed for use in conjunction with a thermal imaging sensor 14′. When an infrared source 24′ and a thermal imager 14′ are employed, the output radiation 22 of radiation source 24′ may be controlled by shutter drive 176 to drive a shutter 175 which opens at the beginning of a thermal imager scan and closes at the end of the scan in synchronization with frame scan rate of thermal imager 14′. Shutter 175 gives a sharp cut off to radiation source 24′ to prevent imaging effects of afterglow. The synchronism is accomplished by a conventional synchronizer 178 coupled over line 177 to shutter drive 176 well known to those skilled in the art. Synchronizer 178 is coupled over line 179 to sensor 14′. Shutter drive 176 is coupled over line 180 to voltage V. A ground is coupled to both synchronizer 175 and shutter drive 176.

In the preferred embodiment, and referring to FIG. 1, the distance from the objective lens 82 to the first image focal point 66 has an effective focal length on the order of 10.2 centimeters. When the light emitting diode 25 is employed, the angular diameter of the source image at focal point 75 at sensor 14 is on the order of two pixels or 236 microradians. The diameter of the source aperture 36 is on the order of 0.019 centimeter which is relatively large, permitting the alignment of the laser beam 107 at beamsplitter 34 to the laser position error detector 122 with little difficulty. The effective focal length from collimating lens 98 to detector 122 is on the order of 10.2 centimeters. The divergence of the laser beam 112 at the output port 81 is on the order of 0.25 milliradian. The diameter of the laser image 120 at detector 122 is on the order of 0.02 centimeter and the angular sensing resolution is on the order of 0.25 milliradian. Under these conditions, thermally-induced drift in apparent null position equivalent to 0.1 image diameter may be expected. An alignment error on the order of 0.00125 centimeter between the detector null point 140 and the source aperture center at focal point 30 may be expected which is equivalent to an error on the order of 0.125 milliradian. The boresight error of laser beam 112 at the output port 81 is on the order of 0.042 milliradian with respect to axis 70.

When the infrared source 24′ and thermal imager 14′ are employed, the field angle of imager 14′ is on the order of twice the field of view. For a narrow field of view on the order of 2.7 degrees, the field of view at beam splitter 58 is on the order of 5.4 degrees or 94.5 milliradians. The angular size of radiation beam 22 from source 24 is on the order of 0.236 milliradian which can be obtained with a 25.4 centimeter focal length projector and a 0.0061 centimeter diameter aperture. The frame scan of the thermal imager 14' is on the order of 30 $H_Z$.

Figure 9:
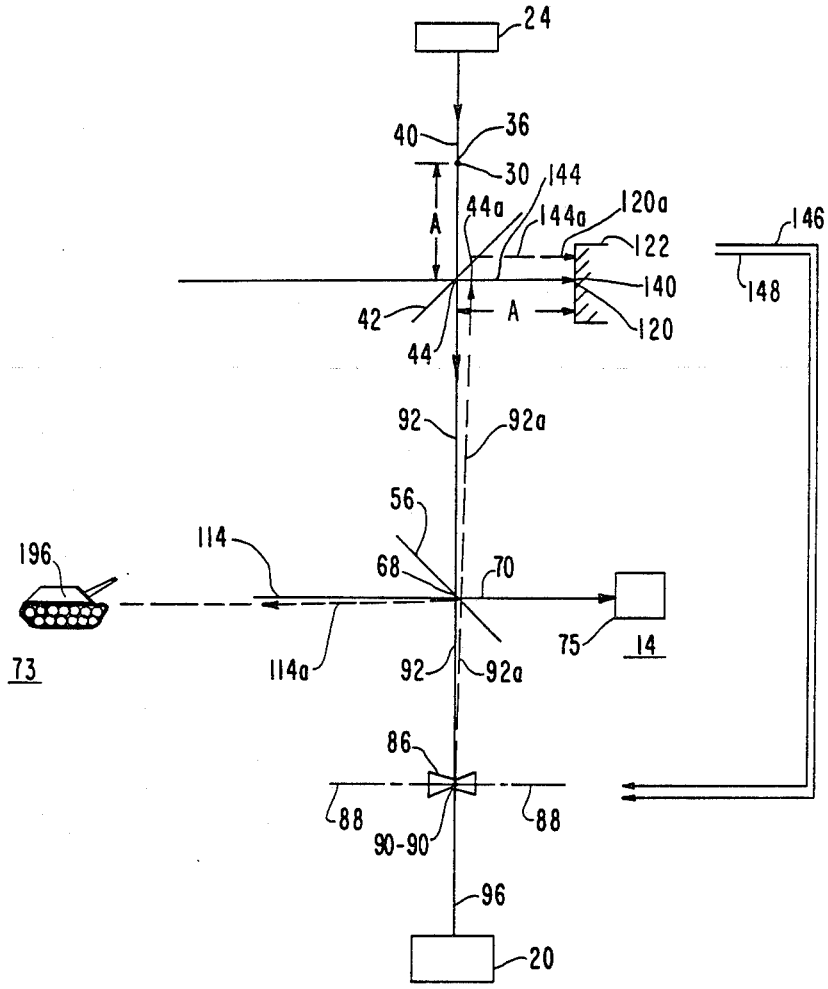
FIG. 9 is a diagram of the geometric relationship between the boresight reference axes and the laser beam axes.

Referring to FIG. 9 in operation, boresighting of laser beam axis 114 with the sensor boresight axis 70 may be automatically and continuously maintained. Axis 70 intersects dichroic mirror 56 of beamsplitter 58 at point 68 which is also the point of intersection of the axis 40 of the radiation source 24. Axis 70 has a fixed relationship with axis 40. The alignment of laser beam axis 114 with axis 70 is achieved when axis 114 also intersects mirror 56 at point 68. The direction of the laser beam axis 92 is changed by moving beam steering lens 86 along its mutually orthogonal axes 88 and 90 in response to displacement error voltages $E_x$ and $E_y$ so that beam axis 92 may be displaced to a different direction relative to that of beam axis 96 until said voltages are nullified. When axis 92 intersects point 68 of mirror 56 for alignment with source beam axis 40, then beam axis 114 extended will be concomitantly boresighted to the boresight reference axis 70 extended and laser leakage beam axes 92 and 144 will intersect point 44 of dichroic mirror 42 and laser leakage beam axis 144 will intersect null point 140 of detector 122. When axis 92 does not intersect point 68 of mirror 56, then reflected laser leakage beam axis **144*a* will not intersect detector point 140 and error voltages $E_x$ and $E_y$ will be generated by detector 122 proportional to the horizontal and vertical displacement respectively of focal point 120*a* from null point 140. The error voltages will cause beam steering lens 86 to be moved along axes 88 and 90 respectively or in combination until focal point 120 is at null point 140. At this point, displacement error voltages will cease being generated by detector 122. When laser leakage beam axis 92*a* is misaligned with respect to boresight reference axis 40, the laser beam axis 114*a* will concomitantly be misaligned relative to the sensor boresight reference axis 70 extended. Reference axis 40 intersects focal point 30 and mirror points 44 and 68; reference axis 144 has a fixed relationship with axis 92 and intersects mirror point 44 and detector null point 140; reference axis 70 has a fixed relationship with axis 40 and intersects mirror point 68 and source image focal point 75. When axis 92*a* is aligned with axis 40 as axis 92, then axis 114*a* will concomitantly be boresighted with reference axis 70 extended and laser focal point 120*a* will be at detector null point 140. Focal points 30 and 140 are equidistant from mirror point 44 at the point of intersection of fixed reference axes 40 and 144. Mirror point 68 is the point of intersection of the boresight reference axis 40, the sensor boresight reference axis 70, the aligned laser beam axis 92, and the aligned reflected laser beam axis 114. When coincidence of said intersections is achieved, the source image focal point 75 will coincide with the image of the target object 196 shown in FIGS. 1, 3 and 9, to which boresighted laser beam 112 is directed and with which boresighted laser beam axis 114** will intersect.

Figure 10:
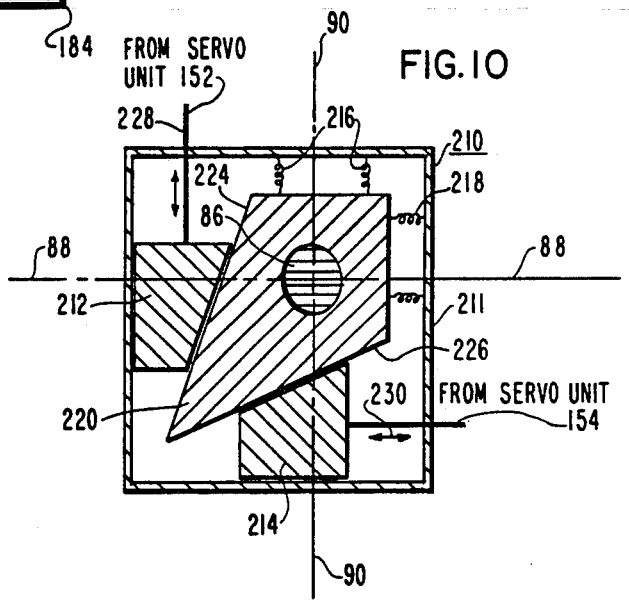
FIG. 10 is an illustration of an example of a deflection lens linear displacement mechanism.

An example of a beam steering lens displacement mechanism 210 illustrated in FIG. 10 provides for moving lens 86 along mutually orthogonal axes 88 and 90 within fixed frame 211 in response to servo units 154 and 152 respectively. Wedge 212 presses against side 224 of lens holder 220 and compresses springs 218; wedge 214 presses against side 226 of holder 220 and compresses springs 216. The wedges 212 and 214 slide along sides 224 and 226 respectively responsive to the amplitude and the direction of the force in linkages 228 and 230 respectively where linkage 228 is connected to servo unit 152 and linkage 230 is connected to servo unit 154.

In operation, wedge 214, when moved to the left parallel to axis 88, will cause lens holder 220 to move upward along axis 90 against springs 216; when wedge 214 is moved to the right, lens holder 220 will move downward along axis 90 in response to the release of pressure on compressed springs 216. Wedge 212, when moved downward parallel to axis 90—90, will cause lens holder 220 to move to the right along axis 88 against springs 218; when wedge 212 is moved upward parallel to axis 90, lens holder 220 will move to the left along axis 88 in response to the release of pressure on compressed springs 218.

What is claimed is:

1. Apparatus for directing a laser beam to an object in a field of view, for aligning said laser beam and for indicating the position of said laser beam in said field of view comprising:

first means for displacing said laser beam in response to an error signal;

second means for both reflecting a first portion of said laser beam and for transmitting the remainder of said laser beam;

third means for both directing said first portion of said laser beam to an object in a field of view and for directing radiant energy from said field of view through said second means into a fourth means for focusing said radiant energy upon a means for indicating;

said second means being transmissive to said radiant energy from said field of view;

fifth means positioned for intercepting said remainder of said laser beam and having a reflective surface at the wavelength of said laser beam for reflecting said remainder of said laser beam onto a detector;

a beam of radiant energy;

said fifth means being transmissive to said beam of radiant energy;

sixth means for focusing said beam of radiant energy through a focal point prior to passing said beam of radiant energy through said reflective surface of said fifth means at the same location said remainder of said laser beam is reflected;

said beam of radiant energy and said sixth means are positioned to direct said beam of radiant energy to said second means;

said second means including means for reflecting said beam of radiant energy into said fourth means;

said fourth means including means for focusing said beam of radiant energy upon said means for indicating; and said detector including means for generating an error signal as a function of the position on said detector where said remainder of said laser beam impinges;

said error signal coupled to said first means.

2. The apparatus of claim 1 wherein said first means for displacing includes means for laterally positioning said laser beam.

3. The apparatus of claim 1 wherein said beam of radiant energy emits energy in the visible electromagnetic spectrum and said means for indicating is a vidicon.

4. The apparatus of claim 1 wherein said beam of radiant energy emits energy in the infrared electromagnetic spectrum and said means for indicating is a thermal imager.

5. The apparatus of claim 1 wherein said error signal comprises at least two error signal components corresponding to the displacement of said remainder of said laser beam along two orthogonal axes transverse to said laser beam.

6. The apparatus of claim 1 wherein the center of said beam of radiant energy at the position passing through said reflective surface of said fifth means is equidistant from a focal point of said reflected remainder of said laser beam at said detector and from said focal point of said beam of radiant energy when said error signal is below a predetermined value.

7. The apparatus of claim 1 wherein the wavelength of said laser beam is independent of the wavelength of said beam of radiant energy.

8. The apparatus of claim 1 wherein said second means includes a dichroic mirror.

9. The apparatus of claim 1 wherein said fifth means includes a dichroic mirror.

10. In a laser beam boresight system including a laser beam source, a reference beam source, and a sensor responsive to a target scene and said reference beam source, a method for boresighting a laser beam axis to a reference axis comprising the steps of:

coupling a first laser beam having a first laser beam axis to a second laser beam having a second laser beam axis;

separating said second laser beam into a third laser beam having a third laser beam axis and a fourth laser beam having a fourth laser beam axis, said third laser beam axis and said fourth laser beam axis having a predetermined relationship with said second laser beam axis;

separating an electromagnetic radiation beam from said reference beam source into a first reference beam having a first reference beam axis and a second reference beam having a second reference beam axis;

detecting the angular displacement between the first reference beam axis and the third laser beam axis and generating an error signal in response to the detected displacement between said axes;

focusing on said sensor an image of said second reference beam and an image of a beam of radiant energy of a target scene, said beam of target scene radiant energy having an axis colinear with said second reference beam axis;

positioning said second laser beam axis in response to said error signal and thereby concomitantly angularly displacing said fourth beam axis into boresight with said target scene radiant energy beam axis whereby the sensor image of said second reference beam corresponds to a target in the target scene with which said fourth laser beam axis intersects.

11. In a laser beam boresight system including a laser beam source, a reference beam source, and a sensor, apparatus for boresighting the laser beam comprising:

means for separating a laser beam from said laser beam source into a first laser beam having a first laser beam axis and a second laser beam having a second laser beam axis, wherein said second laser beam is pointed to a target in a target scene;

said means for separating including means for dividing a reference beam from said reference beam source into a first reference beam and a second reference beam each having a respective reference beam axis;

means for detecting an angular displacement between said first laser beam axis and said first reference beam axis and for generating an error signal indicative of said angular displacement;

means for focusing an image of a target scene and an image of said second reference beam on said sensor wherein the second reference beam axis line of sight intersects said target scene and said sensor images;

means for positoning said laser beam in response to said error signal to cause said angular displacement to reduce until said first laser beam axis is aligned with said first reference beam axis and concomitantly said second laser beam axis is boresighted with said second reference beam axis whereby said second reference beam image corresponds to a target with which said second laser beam axis intersects.

12. The laser beam boresight system in claim 11 wherein said laser operates at a first predetermined wavelength and said reference source operates at a second predetermined wavelength whereby said first and second wavelengths are independent of each other.

13. The laser beam boresight system as defined in claim 11 wherein said first laser beam and said second laser beam have a predetermined angular relationship with each other.

14. The laser beam boresight system as defined in claim 11 wherein said first reference beam and said second reference beam have a predetermined angular relationship with each other.

15. In a laser beam boresight system including a laser beam source, a reference beam source, and a sensor responsive to a target scene and said reference beam source, a method for boresighting a laser beam to a reference axis comprising the steps of:

separating the laser beam from the laser beam source into a first laser beam and a second laser beam, wherein said second laser beam is directed to a target scene, and a reference beam from the reference beam source is divided into a first reference beam and a second reference beam, each of said beams having its respective beam axis;

detecting and generating an error signal indicative of the angular displacement between said first laser beam axis and said first reference beam axis;

focusing an image of a target scene and an image of said second reference beam on said sensor wherein said second reference beam axis extended intersects a target in said scene and said image of said target on said sensor;

positioning said laser beam in response to said error signal to cause said angular displacement to reduce until said first laser beam axis is aligned with said first reference beam axis and thereby concomitantly displacing said second laser beam axis into boresight with said second reference beam axis whereby said second reference beam image on said sensor corresponds to said target with which said second laser beam axis intersects.

* * * * *